US006550542B2

(12) United States Patent
Vienot

(10) Patent No.: US 6,550,542 B2
(45) Date of Patent: Apr. 22, 2003

(54) FLUID PROFILE CONTROL IN ENHANCED OIL RECOVERY

(75) Inventor: Michael E. Vienot, Bartlesville, OK (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 09/907,164

(22) Filed: Jul. 17, 2001

(65) Prior Publication Data

US 2003/0015325 A1 Jan. 23, 2003

(51) Int. Cl.[7] ..... E21B 43/22
(52) U.S. Cl. ..... 166/401; 166/275
(58) Field of Search ..... 166/400, 401, 166/279, 280, 275, 263

(56) References Cited

U.S. PATENT DOCUMENTS 4,276,935 A 7/1981 Hessert et al.
4,456,067 A * 6/1984 Pinner, Jr. ..... 166/279
4,572,295 A 2/1986 Walley
4,624,314 A * 11/1986 Clark ..... 166/271
5,211,231 A 5/1993 Shu et al.
5,314,017 A * 5/1994 Schechter et al. ..... 166/252
5,536,893 A 7/1996 Gudmundsson
5,638,902 A 6/1997 Martin ..... 166/270
5,880,319 A * 3/1999 Sloan, Jr. ..... 585/15
6,035,933 A * 3/2000 Khalil et al. ..... 166/263

OTHER PUBLICATIONS

Gas Conditioning and Processing, Campbell, 1968, pp. 275, 276.*

* cited by examiner

*Primary Examiner*—Frank S. Tsay
(74) *Attorney, Agent, or Firm*—Gary L. Haag

(57) ABSTRACT

Fluid profile in an oil field waterflood operation is controlled after water breakthrough occurs by injecting a hydrate forming hydrocarbon gas into the highly permeable breakthrough zone. The injected gas on contact with water in the breakthrough zone forms a solid gas hydrate to restrict fluid flow in the breakthrough zone.

10 Claims, 1 Drawing Sheet

FLUID PROFILE CONTROL IN ENHANCED OIL RECOVERY

The present invention relates to control of permeability in subterranean oil-bearing formations, and more specifically relates to plugging excessively permeable water channeling zones in waterflood operations.

BACKGROUND OF THE INVENTION

In the production of oil from subterranean formations, it is usually possible to recover only a small fraction of the total oil present in the formation by so-called primary recovery methods which utilize only the natural forces present in the reservoir. To recover oil beyond that produced by primary methods, a variety of supplemental production techniques have been employed. In these supplemental techniques, commonly referred to as secondary or enhanced oil recovery operations, a fluid is introduced into the oil-bearing formation in order to displace oil to a production zone including one or more production wells where the oil is brought to the surface. The drive fluids used in such operations include liquids such as water and various hydrocarbons, and gases such as hydrocarbon gases, carbon dioxide, etc. Often the most cost effective and desirable secondary recovery methods involve the injection of an aqueous or carbon dioxide flooding medium into an oil-bearing formation, where a number of injection and offset production wells have been arranged in a given pattern to produce the field.

While conventional waterflooding is generally the most cost effective method for obtaining additional oil from a reservoir, it has a number of shortcomings. Foremost among these shortcomings is excess water and decreased oil production in some of the offset producing wells in the field and not in others, which results in increased production costs and reduced oil production rate. The uneven production pattern usually appears after waterflooding has been on-going for some time and is thought to result from the tendency of injected flood water to eventually find a low resistance flow path around or through a partially depleted oil-bearing zone. This prevents uniform water injection into all oil-bearing zones evenly, and the resulting uneven water production in wells in a given waterflood field. In extreme cases, the waterflood channeling continues until a water breakthrough occurs such that large quantities of water drive fluid may channel directly from the injection well to a production well. Further, in this event of uneven distribution, significant quantities of oil may be bypassed and left unproduced in low permeability zones unless measures are taken to plug the high permeability bypass or so called "thief" zones.

To solve the problem of undesired channelization in formations, voluminous previous work in the field has sought to chemically form precipitates within the subterranean formations which are capable of sealing off the highly permeable zones or channels so that the water flood drive fluid would be diverted to the under-swept low permeability oil containing regions of the reservoir. The process for controlling permeability of subterranean formations is usually referred to as "profile control."

In previous experiences, oil/water emulsions, gels formed by crosslinking polymers, etc., have been used for forming channel blocking precipitates which are relatively rigid. These channel blocking techniques, in which two or more separate fluids may be injected, have been applied with varying degrees of success. These channel blocking agents have been used in different types of reservoirs, and under diverse reservoir conditions of pressure, temperature, acidity, etc.

Accordingly, it is an object of this invention to seal off water producing zones of high permeability in a waterflood operation, without affecting less permeable oil producing zones.

It is a more specific object to seal off highly permeable subterranean zones which have been cooled by flood water that is much colder than the reservoir fluids.

A still more specific object is to seal off highly permeable subterranean zones near the well bore penetrating the zone.

Yet another object of this invention is to increase the efficiency of a drive fluid passing through a formation and thereby increase the yield of hydrocarbon fluids.

SUMMARY OF THE INVENTION

According to the present invention the foregoing and other objects and advantages are attained in a method for profile control in waterflood recovery operations carried out in a subterranean formation having both moderately permeable and less permeable zones. In a waterflood operations it is desired to enhance production from both zones, however, the oil flow from a more permeable formation is generally depleted before depletion of the less permeable zone. Continued water flood operations result in "water breakthrough" which occurs either through or bypassing the moderately permeable zone. When water breakthrough occurs flood water will be diverted from the low permeability oil producing zones into the channels of a highly permeable zone where it will replace the original subterranean fluid, and produce large quantities of water through the production well. At that time the waterflood operation is ceased and a hydrate forming hydrocarbon gas is injected into the waterflood breakthrough zone. The injected gas on contact with the flood water will form a solid gas hydrate in the highly permeable channels of the breakthrough zone and reduce its permeability. Accordingly, subsequent water drive fluid will be diverted to less permeable oil-containing zones to improve production rate of the oil field.

In a preferred embodiment of this invention the water breakthrough zone will become cooled by the flood water to a temperature that is much colder than the original subterranean fluid. Then the hydrate forming gas is injected through a water injection well to contact the water in the highly permeable zone and form a solid hydrate near the perforations of the injection well to seal off the highly permeable zone taking the water. In an alternate embodiment, the hydrate forming gas is injected through the production well to form a zone of solid hydrate near the perforations of the production well to block water flow into the production well.

Still other objects and advantages of the present invention will become readily apparent to those skilled in this art from the following detailed description and the drawings, wherein there is illustrated and described only one of several preferred embodiments of the invention. As will be realized several details of this invention are capable of modification in various obvious aspects without departing from the invention. Accordingly, the drawings and description are to be regarded as illustrative, and not as restrictive in nature.

BRIEF DESCRIPTION OF THE DRAWINGS

FIG. 1(*b*) is a schematic illustrating injection of a hydrate forming gas into a highly permeable zone of the formation to produce solid gas hydrate surrounding the injection well.

FIG. 1(*c*) is a schematic illustrating diversion of injected flood water into a zone of relatively low permeability.

DESCRIPTION OF THE PREFERRED EMBODIMENT

Figures 1A, 1B, 1C:
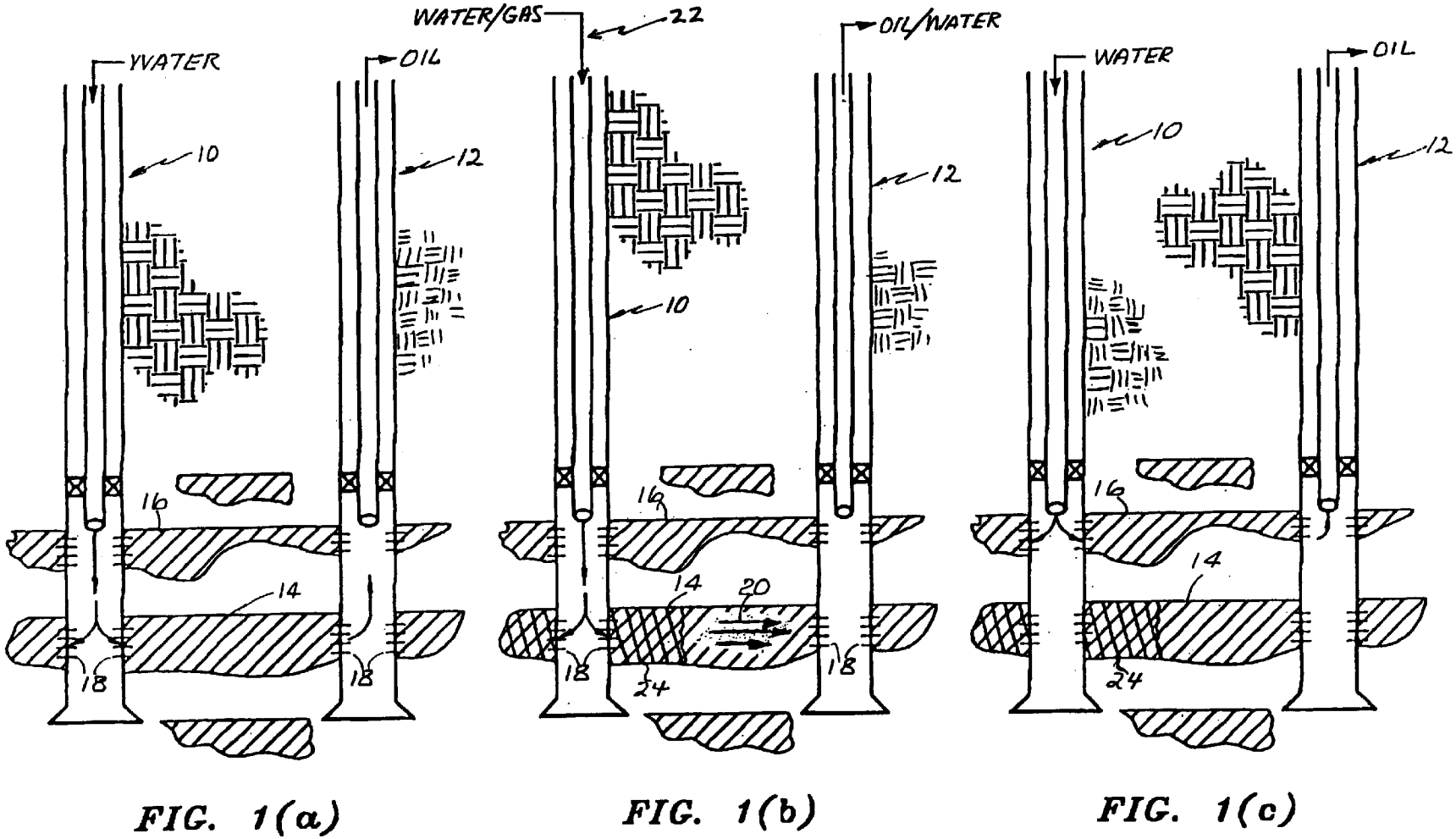
FIG. 1(*a*) is a schematic illustration of waterflooding in a permeable zone for displacing oil to a production well.

Basic to the problem of sealing off thief zones in subterranean formations using hydrate forming hydrocarbon gases is the necessity of cooling the zone to be blocked and injecting the hydrate forming gas where it can physically react with water at elevated pressures and low temperatures. Gas hydrates have been considered a nuisance for years in the gas and oil industry where hydrate formation conditions can be satisfied, e.g., in permafrost areas and in seabed sediments. Accordingly, it is well known that formation of hydrate plugs can stop oil field production, and that hydrates once formed are very difficult to decompose. According to this invention, however, these channel plugging features of gas hydrates are used advantageously to improve production rate of an oil field.

In the practice of this invention, an enhanced oil recovery process including profile control is used to recover oil from a formation. Water flooding processes, which are necessary in this invention, are well known in the art for cost effectively producing additional oil from a reservoir. According to this invention, when a need to seal off a highly permeable zone has been determined based on declining oil production and/or increased water production, duration of waterflood, subterranean temperatures, pressures, etc., the waterflood operation is temporarily terminated until the breakthrough zone has been sealed off. To seal off the breakthrough zone a hydrate forming hydrocarbon gas is injected into the highly permeable breakthrough zone where the gas can physically contact the cold water, and react to form solid gas hydrates. After the highly permeable zone has been sealed off, the waterflood operation is resumed with the flood water being diverted into a zone of lesser permeability within an oil-bearing formation. The formations which are plugged or sealed off can include unconsolidated or loosely consolidated formations such as unconsolidated sand formations.

The gas hydrates are composed of about ninety percent water and about ten percent of one or more of the hydrocarbon gases, methane, ethane, propane, isobutane, or n-butane. Any suitable gas hydrate forming gas may be used for injection in the present invention. Pure light hydrocarbon gases (C1–C4's), or natural gas mixtures, which may be contaminated with other impurities such as particulate and other non-hydrate forming materials, may be used. Particularly preferred in this invention, however, is a sales quality gas that lacks sufficient moisture to form gas hydrates until contacting the water in the highly permeable subterranean formation.

Referring now to FIG. 1, which refers to only one embodiment of the invention, there is illustrated in FIGS. 1(*a–c*) three consecutive stages of enhanced oil field recovery by the waterflood method. In these figures an injection well 10 and a production well 12, which is offset from the injection well, are illustrated as penetrating two zones of oil-bearing formations 16 and 14. As illustrated, the formation 14 is the more permeable formation.

Referring now to FIG. 1(*a*), in the first stage of the waterflood method for enhanced oil recovery, water is pumped down the injection well 10 where it initially enters the higher permeability formation 14 through perforations 18 to force oil through the reservoir rock and into the producing well 12 through it's perforations 18.

In extended waterflood operations as illustrated in FIG. 1(*b*), water injection is replaced by hydrate forming gas injection in the event of a water breakthrough. The breakthrough occurs when the injected water flows directly through the formation 14 without forcing oil toward the production well. This condition is indicated by the arrows 20 in FIG. 1(*b*). Water breakthrough can also occur when the injected water bypasses the reservoir through a newly formed highly permeable path (not illustrated) and reaches the producing well without forcing oil through the reservoir. In either event, the water breakthrough is not desired because the well 12 produces water while bypassing oil remaining in the formations which the water drive fluid is intended to produce.

According to this invention, once water drive fluid has broken through into a production well, the waterflood operation is temporarily terminated leaving the well in the condition where the drive water has replaced the original fluid in the highly permeable breakthrough region. During water breakthrough the formation is cooled, and while being cooled a temperature contour is developed in the breakthrough zone. Accordingly, the highly permeable or "thief" zone swept by the waterflood will have the lowest temperatures of the adjoining formations, while the adjoining formations not contacted by the flood water will have higher temperatures, so as to create conditions which are favorable for forming of solid gas hydrates. This highly permeable flow path through the formation 14 is illustrated by the arrows 20 in FIG. 1(*b*).

The hydrate forming gas is then injected into the well 10, as shown by the arrow 22 in FIG. 1(*b*), and into the formation 14 through perforations 18, where the gas will flow into the highly permeable zone of formation 14. The hydrate forming gas then contacts the water in the highly permeable zone to form solid gas hydrates near the perforations 18 of the injection well 10 as shown at 24 in FIG. 1(*b*). The thus formed solid gas hydrates seal off the breakthrough or so called "thief" zone.

In the final stage, illustrated in FIG. 1(*c*), the enhanced oil recovery using the waterflood method is resumed where the drive water is now diverted to flow through the less permeable but oil-containing formation 16, thus restoring oil production from the oil field.

Although the present invention has been described with a single preferred embodiment, it is to be understood that modifications and variations may be resorted to without departing from the spirit and scope of this invention, as those skilled in the art will readily understand. Such modifications and variations are considered to be within the purview and scope of the appended claims.

That which is claimed is:

1. A method for restricting fluid flow in a highly permeable fluid flow path in a subterranean formation created during a waterflood operation in an oil field, said method comprising the following steps:

(*a*) injecting a water drive into said highly permeable fluid flow path during said waterflood operation, wherein said water displaces a previous fluid in said highly permeable flow path;

(*b*) ceasing said waterflood operation after water breakthrough occurs, whereby said water remains in said highly permeable fluid flow path on ceasing said waterflood operation; and (*c*) injecting a hydrate forming hydrocarbon gas into said highly permeable fluid flow path, wherein said hydrocarbon gas reacts with said water remaining in said highly permeable flow path to form a solid gas hydrate which restricts flow in said highly permeable fluid flow path.

2. A method in accordance with claim 1, wherein said water drive fluid is significantly colder than said previous fluid.

3. A method in accordance with claim 1, wherein said hydrate forming hydrocarbon gas is selected from the group of hydrocarbon gases consisting of: methane, ethane, propane, isobutane and n-butane or mixtures thereof.

4. A method in accordance with claim 1, wherein said hydrate forming hydrocarbon gas is a sales quality hydrocarbon gas that lacks sufficient moisture content to form gas hydrates.

5. A method in accordance with claim 1, wherein said highly permeable fluid flow path comprises a path through an unconsolidated sand formation.

6. A method in accordance with claim 1, wherein said previous fluid comprises petroleum oil.

7. A method in accordance with claim 1, wherein said hydrate forming hydrocarbon gas is injected into said fluid flow path through an injection well in an oil field.

8. A method in accordance with claim 1, wherein said hydrate forming hydrocarbon gas is injected into said fluid flow path through a production well in an oil field.

9. A method in accordance with claim 1, wherein injection of said hydrate forming hydrocarbon gas is terminated and injection of said waterflood operation is resumed after forming said solid gas hydrates to restrict said highly permeable fluid flow paths.

10. A method in accordance with claim 9, wherein said subterranean formation comprises a plurality of oil bearing zones having various permeability and wherein resumption of said waterflood operation directs said water drive through an oil-bearing zone of lower permeability than the waterflood occurring prior to said hydrate forming hydrocarbon gas injection.

* * * * *